US011779139B2

(12) United States Patent
Castaldo

(10) Patent No.: US 11,779,139 B2
(45) Date of Patent: Oct. 10, 2023

(54) DISC PILLOW FOR SUPPORTED RANGE OF MOTION AND ATTENUATION

(71) Applicant: Raymond L Castaldo, Springfield, IL (US)

(72) Inventor: Raymond L Castaldo, Springfield, IL (US)

( * ) Notice: Subject to any disclaimer, the term of this patent is extended or adjusted under 35 U.S.C. 154(b) by 640 days.

(21) Appl. No.: 16/939,008

(22) Filed: Jul. 26, 2020

(65) Prior Publication Data

US 2022/0022669 A1 Jan. 27, 2022

(51) Int. Cl.
*A47G 9/10* (2006.01)

(52) U.S. Cl.
CPC ..... *A47G 9/1009* (2013.01); *A47G 9/1081* (2013.01); *A47G 2009/1018* (2013.01)

(58) Field of Classification Search
CPC ..... A47G 9/10; A47G 9/1045; A47G 9/1009; A47G 9/1081; A47G 2009/1018
See application file for complete search history.

(56) References Cited

U.S. PATENT DOCUMENTS 8,065 A * 4/1851 Towers ..... G06F 3/03543 248/118.5
414,748 A * 11/1889 Bentley ..... A47G 9/10 5/636
457,180 A * 8/1891 Cameron ..... A47G 9/10 5/491
808,217 A * 12/1905 Reich ..... A47G 9/1009 5/643
1,703,629 A * 2/1929 Lange ..... A47G 9/10 428/6
RE17,607 E * 2/1930 Lange ..... A47G 9/10 5/645
2,700,779 A 2/1955 Tolkowsky
3,829,917 A 8/1974 De
3,848,281 A * 11/1974 Mathews ..... A47G 9/10 5/636
4,285,081 A 8/1981 Price
4,494,261 A 1/1985 Morrow
4,550,458 A 11/1985 Fiore
4,754,513 A 7/1988 Rinz
4,914,763 A 4/1990 Clark
(Continued)

FOREIGN PATENT DOCUMENTS

JP 167325 A 9/2011
KR 20180080808 A * 4/2018
WO 050119 A2 4/2011

OTHER PUBLICATIONS

Lindell, Mike, My Pillow, https://help.mypillow.com/hc/en-us/articles/7791142868123-Comparing-Different-MyPillows.

*Primary Examiner* — Eric J Kurilla

(57) ABSTRACT

One embodiment of a pillow for sleeping or resting having a supportive rigid or semi-rigid bowl (10) covered on its upper concave surface with a layer or layers of fill material (20) and a cover (12) which form a ridge (14) as they extend over the rim (18) of the bowl and fasten to an attachment site (16) on the lower convex surface of the bowl. The upper surface of the pillow receives the head of an individual securely and the pillow is capable of tilting in unison with the movement of the head in a plurality of directions to facilitate movement. The ridge of fill material provides comfort and gentle attenuation of the range of tilt of the pillow. Other embodiments are described as shown.

19 Claims, 5 Drawing Sheets

(56) References Cited

U.S. PATENT DOCUMENTS

| | | | | |
|---|---|---|---|---|
| 5,016,303 | A | 5/1991 | Tanaka | |
| 5,271,114 | A | 12/1993 | Kjersem | |
| 5,781,947 | A | 7/1998 | Sramek | |
| 5,933,890 | A * | 8/1999 | Codd | A47G 9/1009 5/636 |
| 6,052,850 | A * | 4/2000 | Salido | A47G 9/10 5/655 |
| 6,055,687 | A | 5/2000 | Matthews | |
| 6,098,220 | A * | 8/2000 | Momma | A47G 9/1045 5/639 |
| 6,457,195 | B1 | 10/2002 | Holste | |
| 6,536,058 | B1 * | 3/2003 | Chang | A61F 5/01 5/636 |
| 7,461,424 | B2 | 12/2008 | Lindell | |
| 7,793,371 | B1 | 9/2010 | Leach | |
| 8,418,293 | B2 | 4/2013 | Tansingco | |
| 9,974,400 | B2 * | 5/2018 | Zuber | A47G 9/1063 |
| 10,543,394 | B2 * | 1/2020 | Mandell | A63B 21/4039 |
| D893,218 | S * | 8/2020 | Han | D6/601 |
| 2004/0107501 | A1 * | 6/2004 | Kancilja | A47G 9/10 5/636 |
| 2006/0010580 | A1 * | 1/2006 | Long | A47G 9/10 2/413 |
| 2007/0287942 | A1 * | 12/2007 | Tullous | A61G 7/072 602/17 |
| 2014/0317852 | A1 | 10/2014 | Chen | |
| 2017/0095096 | A1 * | 4/2017 | Mandell | A47C 15/00 |
| 2020/0221880 | A1 * | 7/2020 | Rogers | A47G 9/10 |
| 2021/0282577 | A1 * | 9/2021 | Leezer-Cumiford | A47G 9/1081 |
| 2022/0022671 | A1 * | 1/2022 | Romano | B32B 17/10633 |

* cited by examiner

DISC PILLOW FOR SUPPORTED RANGE OF MOTION AND ATTENUATION

BACKGROUND—PRIOR ART

A pillow is generally understood as a soft object for support of the head and neck of an individual. This broad definition allows for a variety of shapes, sizes, and materials. The common function of these pillows is the embedding of the head into the substance of the fill material. A drawback of a pillow is that this receptivity and support is also restrictive to head and neck movement. The fill material creates resistance to the periodic subtle head movements which are needed and desired for good quality sleep. Excessive effort is needed to reposition the head in various orientations on the fill material of currently available pillows. Quality of sleep and depth of sleep can be adversely affected by intermittent sleep interruption when repositioning the head and neck. Limitation of head and neck movement can result in excessive and uneven pressure on the head and scalp. It also can restrict blood flow to the head. The airway can become obstructed and result in snoring or obstructive sleep apnea.

A plurality of proposed pillows are comprised of fill material with a cover. A relatively recent example of prior art describes a variation of fill material. This is proposed in U.S. Pat. No. 7,461,424B2 to Lindell (2008) which describes a specific fill material having foam pieces of various sizes and shapes. The basic shape of this pillow and manner of use does not substantially differ from previous proposals. Cushion, conformability, and shape adjustability of the fill material are described but the range of motion of the head and neck is not substantially addressed. My Pillow® as pictured at https://help.mypillow.com/hc/en-us/articles/7791142868123-Comparing-Different-MyPillows is marketed as improving spinal alignment for each individual user. It does not, however, sufficiently address the fluid nature of sleep position and the need for periodic adjustments in head and neck position in a plurality of directions. These adjustments are helpful for a plurality of reasons including comfort, alleviation of muscle stiffness, improvement in blood circulation, and maintenance of airway patency. This pillow method and apparatus illustrates how the basic concept of a pillow with fill material and cover has remained fundamentally unchanged.

Other pillows have been proposed to modify the support of the traditional pillow. U.S. Pat. No. 2,700,779A to Tolkowsky (1955) proposed a therapeutic pillow. It is described as overcoming the displacement of the head from the position of longitudinal and axial extension of the spinal column. The intent is to relieve muscular tension. This pillow provides a static form of support but does not substantially facilitate movement of the head and neck. It does not allow the head to be easily repositioned throughout sleep or rest. The user of the pillow is therefore subjected to discomfort and stiffness. Periodic deliberate repositioning of the head and neck is needed during sleep. Similarly, U.S. Pat. No. 3,829,917A to De, Laittre (1974) and foreign patent JP 167325A to Morita (2011) provide head and neck support without substantially facilitating the range of motion.

Other U.S. patents such as U.S. Pat. No. 4,285,081A to Price (1981), U.S. Pat. No. 4,494,261A to Morrow (1985), U.S. Pat. No. 4,550,458A to Fiore (1985), and U.S. Pat. No. 4,754,513A to Rinz (1988) propose support structures of various shapes and contours which are either incorporated in the pillow or function in association with the pillow. These proposals also suffer from the drawback of restricted motion of the head and neck.

Other pillows have been proposed which offer support to various areas of the head, neck, and trunk in specified positions and postures such as U.S. Pat. No. 4,914,763A to Clark (1990), U.S. Pat. No. 5,016,303A to Tanaka (1991), U.S. Pat. No. 5,271,114A to Kjersem (1993), U.S. Pat. No. 5,781,947A to Sramek (1998), U.S. Pat. No. 6,055,687A to Matthews (2000), U.S. Pat. No. 6,457,195B1 to Holste (2002), and U.S. Pat. No. 7,793,371B1 to Leach (2010). These pillows offer support in various positions of the head and neck to provide comfort, stability, and pressure distribution. These pillows, however, also have the drawback of restricted movement of the head and neck.

Position of the head to the right or left is addressed in U.S. Pat. No. 8,418,293B2 (2013) and foreign patent WO 050119A2 (2011), both to Tansingco. A pillow is proposed to provide support for "frontal or side to side" positions. This proposal suffers from the disadvantage of not substantially allowing freedom of motion of the head and neck from one position to another. The user must make a concerted effort to adjust head and neck position.

US patent 20140317852A1 to Chen (2014) proposes a pillow with a shock absorbing and pressure relief cushion cover. Hollow compartments within the pillow allow for adjustments in support of the head. This pillow is proposed to stabilize movement of the head of the user and provide appropriate support to the user according to the body type of the individual person. The drawback is that the pillow does not substantially respond to motion of the head and neck of the user.

Motion of the head during sleep or rest is insufficiently addressed in U.S. Pat. No. 6,098,220A to Momma (2000). The proposed pillow is described as "being generally U-shaped" and capable of rolling with the head of an individual to the right and left sides. A significant limitation of this pillow is that it does not substantially facilitate motion of the head in a plurality of directions. Another drawback of this pillow is the relatively soft material which contacts the sleeping surface. This soft material does not substantially facilitate rolling or tilting of the pillow over the soft surface of the bed or other sleeping surface. It is therefore not sufficiently responsive to attempted subtle adjustments of head and neck movement during sleep or rest. Additionally, this pillow does not substantially prevent excessive rotation of the head and neck to the right or left.

Pillows heretofore suffer from a number of disadvantages:

a) Embedding of the head into fill material can become uncomfortable due to uneven pressure distribution.
b) Restriction of head and neck movement can result in problems such as discomfort, stiffness, poor circulation to the head, airway obstruction, snoring, and sleep apnea.
c) Concerted effort is required for repositioning of the head and neck. This interferes with sleep and rest.
d) Range of motion of the head and neck is substantially limited in a plurality of directions.
e) Pillows which do allow some movement of the head and neck lack an effective safeguard to prevent excessive movement.

SUMMARY

In accordance with one embodiment a disc pillow comprises a rigid or semi-rigid concave bowl with a layer or layers of fill material and a cover which extend over the upper concave surface of the bowl and form a ridge over the rim of the bowl and attach to the lower convex surface of the bowl.

Advantages

Accordingly several advantages of one or more aspects of a disc pillow are as follows: to provide a pillow with a rigid or semi-rigid bowl which supports the head and neck within a comfortable range of motion, that tilts in unison with the head, that facilitates gentle muscular movement of the neck, and that gently attenuates head and neck movement within a comfortable range of motion. Other advantages of one or more aspects will be apparent from a consideration of the drawings and ensuing description.

DRAWINGS—FIGURES

In the drawings, closely related figures have the same number but different alphabetic suffixes.

Figure 1A:
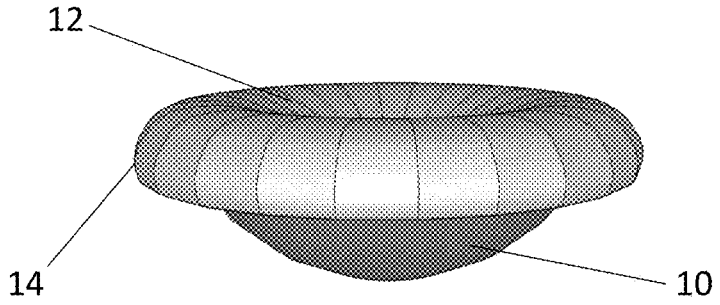
FIGS. 1A to 1C show various aspects and orientations of a disc pillow with rigid or semi-rigid bowl and cover in accordance with one embodiment.

| Drawings-Reference numerals | |
|---|---|
| 10 bowl | 12 cover |
| 14 ridge | 16 attachment site |
| 18 rim | 20 fill material |
| 22 sleeping surface | 24 indented sleeping surface |
| 26 notch | 28 superior truncation |
| 30 inferior truncation | 32 superior edge |
| 34 inferior edge | 36 right edge |
| 38 left edge | |

DETAILED DESCRIPTION—FIGS. 1A TO 2B—FIRST EMBODIMENT

Figure 1B:
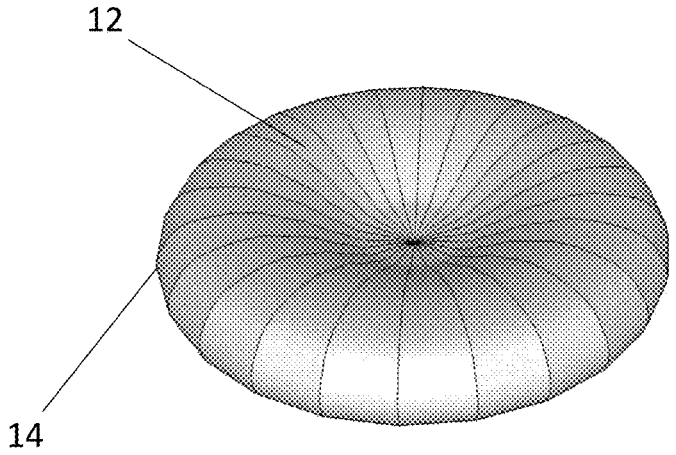
Figure 1C:
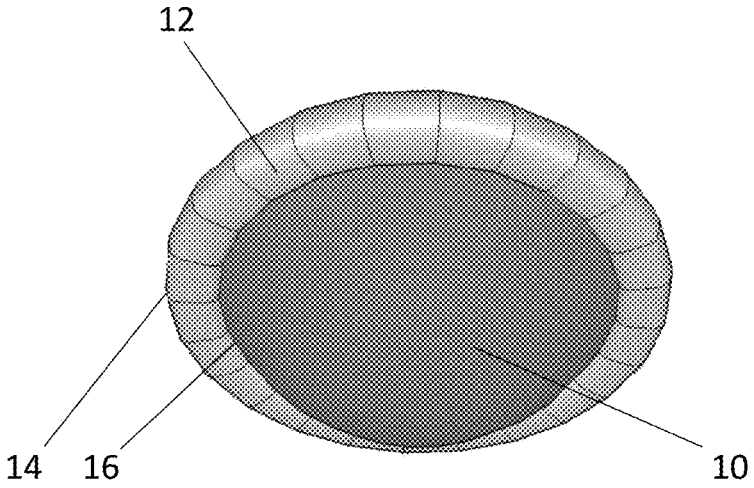

One embodiment of a disc pillow is illustrated in FIG. 1A (side view), FIG. 1B (top view), and FIG. 1C (bottom view). FIG. 1A shows a side view of the disc pillow. A cover 12 extends over the upper concave surface of the disc pillow and attaches to the lower convex surface of a bowl 10. A ridge 14 extends around the circumference of the disc pillow. The cover can be comprised of cotton, wool, polyester, nylon, rayon, linen, cashmere, leather, suede, silk, satin, or a similar substantially sturdy, pliable, and comfortable material. The cover is shown with radially oriented sections but other configurations of the cover material such as square, rectangular, circular, elliptical, or irregular may be used. The bowl can be comprised of plastic, metal, nylon, wood, rubber, wicker or any suitable rigid or semi-rigid material which can substantially support the weight and motion of an individual head.

FIG. 1B shows the disc pillow tilted downward revealing a greater area of cover 12 and ridge 14. FIG. 1C shows the disc pillow tilted upward revealing a greater area of bowl 10. Cover 12 extends over ridge 14 to an attachment site 16 on the lower surface of bowl 10. Attachment site 16 can be comprised of elastic, glue, stitching, snaps, laces, touch fastener, or any substantially secure material and method.

The size of the disc pillow can be based on the size of an individual head. The size of the disc pillow can also be based on personal preferences.

Figure 2A:
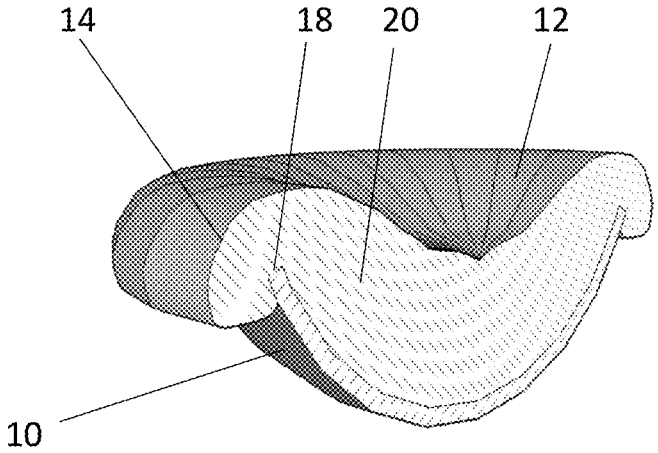
FIGS. 2A and 2B show cross-sectional views through the widest diameter of a disc pillow with rigid or semi-rigid bowl, fill material, and cover in accordance with other embodiments.
Figure 2B:
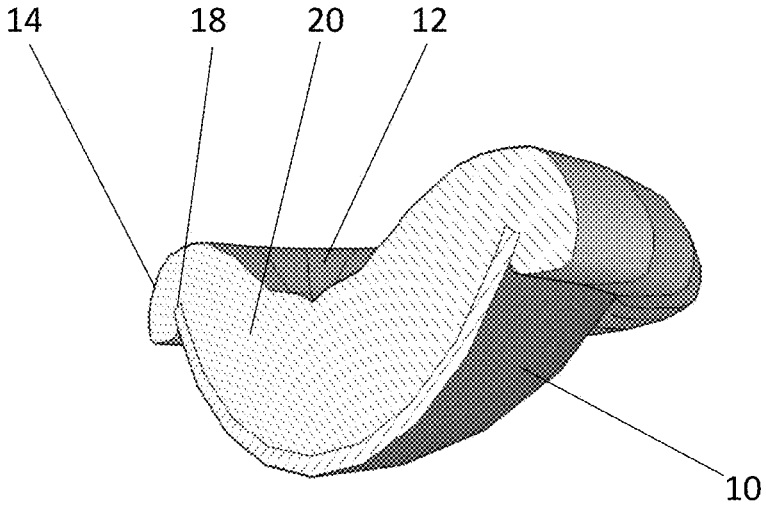

FIGS. 2A and 2B show cross-sectional views through the widest diameter of the disc pillow. FIG. 2A shows a cross-sectional surface of the disc pillow directed to the right and slightly downward with respect to the viewer. Hatched lines, angled from lower left to upper right, demonstrate the cross-sectional surface of the bowl. A rim 18 of the bowl is seen on the cross-sectional surface. Cover 12 and a fill material 20 extend over the upper concave surface of bowl 10. Hatched lines, angled from upper left to lower right, demonstrate the cross-sectional surface of fill material 20. The fill material can be comprised of cotton, wool, fiber, down, feathers, foam, memory foam, gel, liquid, or any material or combination thereof which can substantially cushion and support the head. The fill material can be solid or in the form of beads, chips, particles, shreds, or any desired shape or size to allow the pillow shape to be adjustable. Ridge 14 is substantially formed by the fill material and fabric as they extend over rim 18. The thickness of the fill material will depend on the amount of fill material used.

FIG. 2B shows the cross-sectional surface of the disc pillow directed to the left and slightly upward with respect to the viewer. Hatched lines again demonstrate the cross-sectional surfaces of the bowl and fill material. The lower convex surface of bowl 10 is substantially revealed. The upper concave surface of the bowl is covered by fill material 20 and cover 12 which form ridge 14 over rim 18.

Figure 3A:
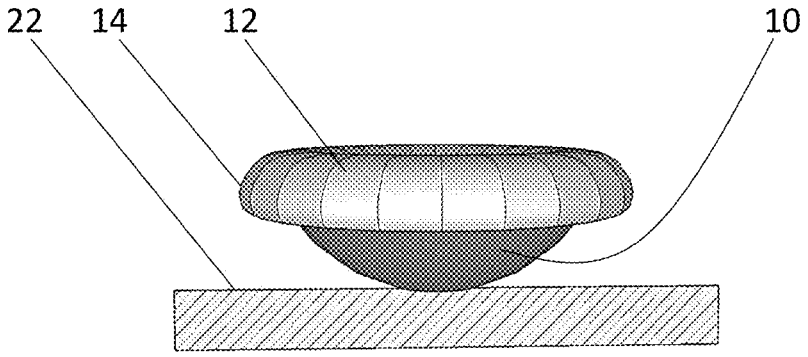
FIGS. 3A to 3C show side views of various orientations of a disc pillow on various sleeping surfaces in accordance with other embodiments.
Figure 3B:
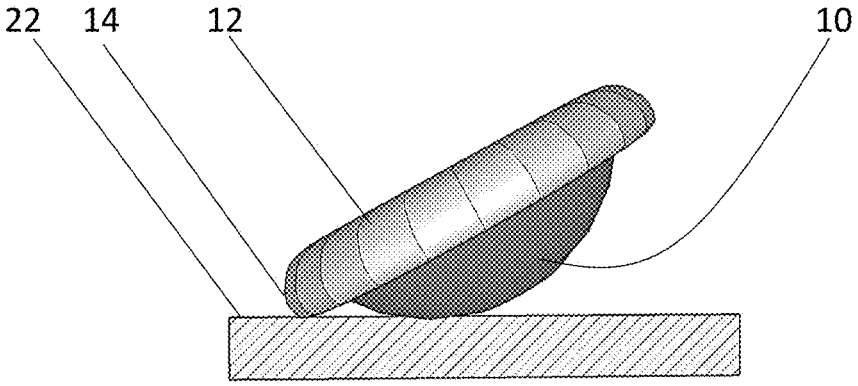
Figure 3C:
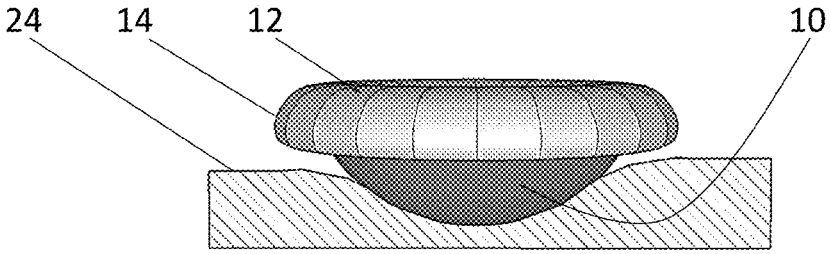

Operation—FIGS. 3A-3C

The manner of using the disc pillow involves positioning the disc pillow such that the convex surface is facing downward. FIGS. 3A to 3C show a disc pillow in various positions on various surfaces. Bowl 10, cover 12, and ridge 14 are shown in these embodiments. FIG. 3A illustrates a side view of the disc pillow with the bottom of bowl 10 on a sleeping surface 22. Hatched lines, angled from lower left to upper right, demonstrate a cross section of the sleeping surface. An individual head is placed on top of the disc pillow. The shape of the disc pillow provides substantially uniform pressure distribution on the surface of the head. Ridge 14 provides support for the neck. The center of the bowl is in contact with the sleeping surface in this embodiment. The bowl is shown in a level or neutral position. The head of an individual can be kept in the neutral position or the head can be turned in any direction such as left, right, upward, downward, or along any diagonal radius. The disc pillow moves in unison with the head and thereby provides means to facilitate movement of the head.

FIG. 3B shows a side view of the disc pillow in a tilted orientation on sleeping surface 22. Hatched lines, angled from lower left to upper right, again demonstrate a cross section of the sleeping surface. Bowl 10 is tilted such that a peripheral area of the convex surface of the bowl is in contact with sleeping surface 22. The disc pillow is tilted to the extent that ridge 14 is also in contact with sleeping surface 22. The ridge provides means to attenuate the tilt of the bowl and substantially limit the extent of movement of the bowl. Ridge 14 thereby prevents excessive range of movement of the head of the individual user. Bowl 10 substantially allows the disc pillow to tilt in a plurality of directions. Ridge 14 extends around the circumference of the disc pillow and therefore attenuates the extent of the tilt of the disc pillow in a plurality of directions.

FIG. 3C illustrates a side view of the disc pillow on an indented sleeping surface 24. Hatched lines, angled from upper left to lower right, demonstrate a cross section of indented sleeping surface 24. Indented sleeping surface 24 has sufficient softness to receive bowl 10 to a substantial depth. Ridge 14 is therefore closer to indented sleeping surface 24. The depth of the indentation is determined by the combined effects of the softness of the sleeping surface, weight of the pillow, and weight of the head of the individual user on the pillow. Ridge 14 will consequently contact indented sleeping surface 24 after a substantially small amount of tilt of bowl 10. Attenuation of tilt of the disc pillow on a substantially soft sleeping surface is therefore greater than on a substantially firm sleeping surface.

The head of an individual can be placed on the disc pillow in any desired orientation. For example, the left side of the head, right side of the head, or back of the head can be placed on the surface of the disc pillow. The disc pillow can be used on a surface for sleeping as well as a surface for resting. The disc pillow can be placed on any surface including a mattress, bedding, various pillows, furniture, floor, or carpet. Freedom of tilt and degree of tilt of the pillow will be influenced by the degree softness of the surface used. The disc pillow can be placed on top of any other pillow to provide added height when needed or desired. This can substantially modify spinal alignment of the neck when needed.

Figure 4A:
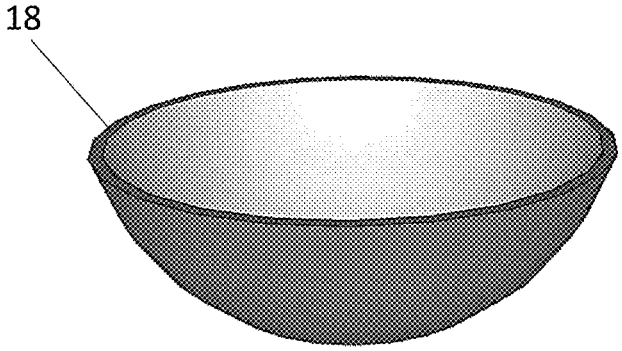
FIGS. 4A and 4B show bowls from disc pillows having various contours in accordance with other embodiments.
Figure 4B:
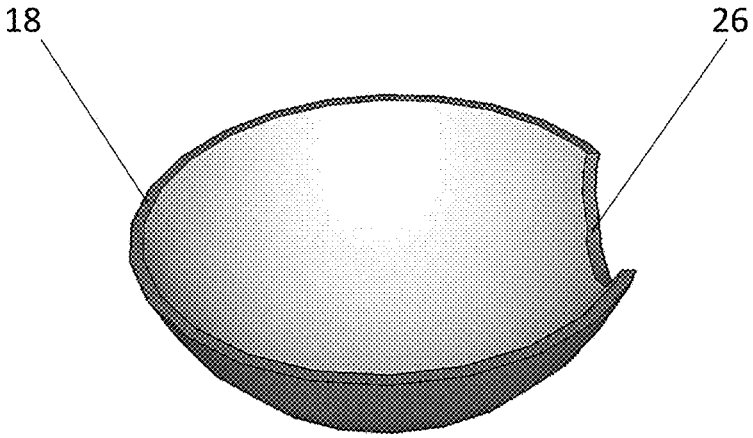

FIGS. 4A-4B—Additional Embodiments

FIG. 4A shows a spherical shaped bowl from a disc pillow. Rim 18 is circular in this embodiment. The spherical shape provides means for tilt in a plurality of directions from the neutral, or level position.

FIG. 4B shows a spherical shaped bowl from a disc pillow which has a notch 26 in one area of rim 18. A notch or notches can be used to customize the bowl contour to avoid unwanted pressure on a specified area or areas of the head or neck or any preferences of the user as desired.

Figure 5A:
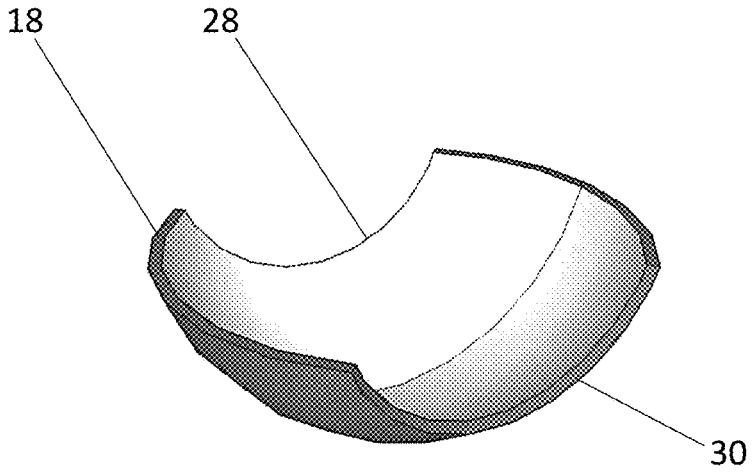
FIGS. 5A and 5B show bowls from disc pillows with alternative shapes and contours in accordance with other embodiments.
Figure 5B:
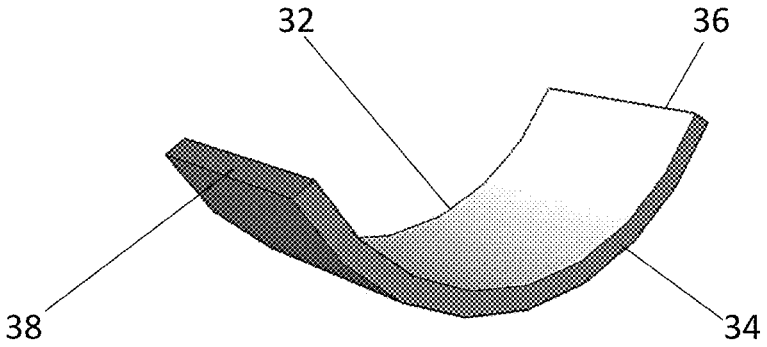

FIGS. 5A-5B—Alternative Embodiments

FIG. 5A shows a spherical shaped bowl from a disc pillow which has a superior truncation 28 and an inferior truncation 30 in relation to rim 18. The truncations represent trimmed or abbreviated sections of the bowl. The superior truncation is shown at the twelve o'clock position relative to the orientation of the head of the individual user. The inferior truncation is shown at the six o'clock position. Truncation in a plurality of sizes can be provided at a plurality of locations around rim 18. Truncation provides means to limit the extent to which the pillow can tilt toward the truncated region. This is because the ridge of the fill material and cover over the truncated region will be closer to the lowest point on the bottom of the bowl. Attenuation of tilt therefore occurs substantially early after the bowl begins to tilt. Superior truncation, for example, provides additional attenuation of the tilt of the disc pillow in the superior direction. This reduces neck extension and can reduce associated snoring.

FIG. 5B shows a cylindrical shaped bowl from a disc pillow. A superior edge 32 and an inferior edge 34 are shown at the twelve o'clock and six o'clock positions respectively relative to the head of the user. A right edge 36 and a left edge 38 are shown from the perspective of the viewer. The cylindrical shaped bowl provides support for the fill material and cover on the upper concave surface and over all four edges with an attachment to the lower convex surface. A ridge is formed by the fill material and cover as they extend over the edges of the bowl. The cylindrical shape of the bowl provides the disc pillow with means of tilting primarily in the lateral or side-to-side directions. The ridge of fill material and cover provides attenuation of the extent of tilt of the disc pillow in the side-to-side directions.

Advantages

From the description above, a number of advantages of some embodiments of the disc pillow become evident:

a) The rigid or semi-rigid bowl supports the head and neck.
b) Fill material over the bowl supports the head and provides comfort.
c) The ridge of fill material provides cushioning over the rim of the bowl for added comfort of the head and neck.
d) The concave shape of the disc pillow with rigid or semi-rigid bowl facilitates freedom of movement of the head and neck in a plurality of directions.
e) Improved freedom of movement of the head and neck enhance comfort, blood circulation, breathing, and sleep quality of the user.
f) The disc pillow moves in unison with the head and supports the head of the user throughout the range of motion of the head and neck.
g) The ridge of fill material over the rim or edge of the bowl ensures gentle attenuation of the extent of the range of motion of tilt of the disc pillow in a plurality of directions. This guards against unusual or extreme positions of the head and neck.
h) A notch or notches in the bowl allows customization of the pillow to fit the individual shape of the head as well as preferences of the individual user.
i) Truncation of the bowl in one or more areas individualizes the tilt characteristics of the disc pillow.
j) The disc pillow substantially limits excessive embedding of the head into the fill material. This improves comfort of the head and neck. It also tends to avoid obstruction of the ears.

CONCLUSION, RAMIFICATIONS, AND SCOPE

Accordingly, the reader will see that the disc pillow of various embodiments can be used to provide support, comfort, and improved quality of sleep or rest. The rigid or semi-rigid bowl provides secure support of the head and neck. The rigid or semi-rigid bowl also provides means for tilt of the pillow in a plurality of directions. Conscious or subconscious movements of the head and neck are facilitated. The ridge of fill material provides means to attenuate tilt of the pillow to maintain the motion of the head and neck within a comfortable range. Furthermore, the disc pillow has the additional advantages in that:

It provides a supportive base for the head while sleeping or resting;
It evenly distributes and reduces pressure on the head;
It reduces strain on the neck;

It facilitates head movement by tilting in unison with the head;

It can tilt in a plurality of directions with minimal resistance;

Airway patency is optimized;

It improves blood circulation to the head;

It improves sleep quality and health by providing substantially low resistance to subtle position changes of the head and neck which reduce snoring, sleep apnea, and unwanted episodes of awakening;

It can be used for sleeping in a plurality of positions including supine or side;

It can be truncated to customize the range of motion of the head and neck for specific needs and desires;

It can be used on a plurality of sleeping or resting surfaces such as a mattress, bedding, various pillows, furniture, floor, or carpet;

It can be produced with a variety of bowl and rim configurations for individual preference and needs;

It can be produced in a variety of colors, textures, styles, sizes, and shapes; and It avoids obstruction of the ears.

Although the description above contains many specificities, these should not be construed as limiting the scope of the embodiments but as merely providing illustrations of some of several embodiments. For example, the pillow can have other shapes, such as circular, oval, or irregular; a plurality of sizes, materials, colors, patterns, and designs may be used; the materials can be hypoallergenic, etc.

Other embodiments of the bowl can include a plurality of dimensions of diameter, radius of curvature, and depth to influence the fit for an individual user and also the degree of tilting; a plurality of bowl shapes can be used including spherical, spheroid, ellipsoid, ovoid, cylindrical, irregular or any suitable shape to allow tilting of the bowl on a surface; a plurality of thickness sizes to accommodate individual choice or need; a plurality of materials or combination of materials to influence strength and flexibility; facets, ridges, grooves, ribs, flat spots, openings, and areas with different radius of curvature to modify the tilting characteristics and performance of the bowl; textures or other surface modifications on either surface of the bowl to influence the characteristics of contact of the bowl with the fill material, cover, and sleeping surface; a plurality of rim shapes such as round, elliptical, square, hexagonal, octagonal, or irregular; a plurality of rim contours including blunt, beveled, rounded, thickened, inward curled, outward curled, serrated, scalloped, or toothed, etc.

Other embodiments of the fill material can comprise multiple materials or combinations of materials; the amount of fill material and thickness of the fill material comprising the ridge of the disc pillow can be preselected to create pillows with different characteristics of support and tilt; the ridge can have a contour which is rounded, beveled, squared, or sculpted into any specific shape as desired; the thickness of the fill material can be varied to provide a particular level of elevation of the head above the sleeping surface; the fill material can be uniform, layered, or compartmentalized, etc.

Other embodiments of the assembled components of the disc pillow can include a cover on the entire upper and lower surfaces of the fill material; alternative means of removable attachment of the cover and fill material to the bowl such as elastic, laces, snaps, touch fastener, or other apparatus; a plurality of means of attachment of the fill material with the cover such as glue or stitching; a plurality of means of attachment of the fill material and cover to the concave surface, convex surface, or rim of the bowl; straps or other apparatus to maintain the pillow in contact with the head of an individual user if preferred, etc.

The scope of the embodiments should be determined by the appended claims and their legal equivalents, rather than by the examples given.

I claim:

1. In a pillow comprising a fill material and enclosed in a cover, wherein said pillow has an underlying rigid or semi-rigid bowl having an upper concave surface, a rim, and a lower convex surface, wherein said fill material and said cover extend over said upper concave surface and said rim forming a ridge of said fill material and said cover over said rim and extending further onto said lower convex surface or portion thereof having means for attachment of said fill material and said cover to said bowl.

2. The pillow of claim 1 wherein said fill material is comprised of a material selected from a group consisting of cotton, wool, fiber, down, feathers, foam, memory foam, gel, and liquid or any combination thereof.

3. The pillow of claim 1 wherein said cover is comprised of a material selected from a group consisting of cotton, wool, polyester, nylon, rayon, linen, cashmere, leather, suede, silk, and satin or any combination thereof.

4. The pillow of claim 1 wherein said rigid or semi-rigid bowl is comprised of a material selected from a group consisting of plastic, metal, nylon, wood, rubber, and wicker or any combination thereof.

5. The pillow of claim 1 wherein said bowl is comprised of a shape selected from a group consisting of spherical, spheroid, ellipsoid, ovoid, and cylindrical.

6. The pillow of claim 1 wherein said rim is comprised of a contour selected from a group consisting of blunt, beveled, rounded, thickened, inward curled, outward curled, serrated, scalloped, or toothed.

7. The pillow of claim 1 wherein said ridge is comprised of a shape selected from a group consisting of rounded, beveled, and squared.

8. The pillow of claim 1 wherein said pillow has a predetermined size to substantially support an individual head.

9. The pillow of claim 1 wherein said means of attachment of said fill material and said cover to said bowl is comprised of means selected from a group consisting of glue, rivets, snaps, laces, stitching, straps, elastic, and touch fastener or combination thereof.

10. A pillow, comprising:

a) a fill material b) a rigid or semi-rigid bowl having an upper concave surface, a rim, and a lower convex surface c) a cover over said fill material, and d) means for joining said fill material and said cover to said upper concave surface, said rim, and said lower convex surface or portion of said lower convex surface characterized in that said fill material and said cover form a ridge over said rim.

11. The pillow of claim 10 wherein said fill material is comprised of cotton, wool, fiber, down, feathers, foam, memory foam, gel, liquid or any combination thereof.

12. The pillow of claim 10 wherein said cover is comprised of cotton, wool, polyester, nylon, rayon, linen, cashmere, leather, suede, silk, satin or any combination thereof.

13. The pillow of claim 10 wherein said rigid or semi-rigid bowl is comprised of plastic, metal, nylon, wood, rubber, wicker or any combination thereof.

14. The pillow of claim 10 wherein said bowl has a predetermined shape comprising spherical, spheroid, ellipsoid, ovoid, or cylindrical.

15. The pillow of claim 10 wherein said rim has a predetermined contour comprising blunt, beveled, rounded, thickened, inward curled, outward curled, serrated, scalloped, or toothed.

16. The pillow of claim 10 wherein said ridge has a predetermined shape comprising rounded, beveled, or squared.

17. The pillow of claim 10 wherein said pillow has a predetermined size to support an individual head.

18. The pillow of claim 10 wherein said means for joining said fill material and said cover to said bowl comprises glue, rivets, snaps, laces, stitching, straps, elastic, touch fastener, or combination thereof.

19. A method of using a pillow, comprising:

a) Providing a pillow comprising a fill material and a cover over a rigid or semi-rigid bowl having an upper concave surface, a rim, and a lower convex surface wherein said fill material and said cover extend over said upper concave surface forming a ridge over said rim and extending further onto said lower convex surface or portion thereof, b) Positioning said pillow on a sleeping or resting surface with said convex surface facing downward on said sleeping or resting surface, c) Placing a head of an individual onto said pillow, d) Allowing said pillow to tilt in unison with motion of said head in a plurality of directions, e) Providing attenuation of said tilt of said pillow by said ridge, whereby said pillow substantially supports and facilitates said motion of said head in a plurality of directions while attenuating the extent of said motion.

* * * * *